US010882159B2

(12) United States Patent
Cheng et al.

(10) Patent No.: US 10,882,159 B2
(45) Date of Patent: Jan. 5, 2021

(54) CONTROL VALVE FOR SHOT PEENING

(71) Applicant: ABRASIVE ENGINEERING PTE LTD, Singapore (SG)

(72) Inventors: Chia Loon Cheng, Singapore (SG); Chong Wei Lee, Singapore (SG); Keng Huat Tan, Singapore (SG); Ser Hean Tan, Singapore (SG)

(73) Assignee: ABRASIVE ENGINEERING PTE LTD, Singapore (SG)

( * ) Notice: Subject to any disclaimer, the term of this patent is extended or adjusted under 35 U.S.C. 154(b) by 25 days.

(21) Appl. No.: 16/078,358

(22) PCT Filed: Mar. 2, 2017

(86) PCT No.: PCT/SG2017/050099
§ 371 (c)(1),
(2) Date: Aug. 21, 2018

(87) PCT Pub. No.: WO2017/180058
PCT Pub. Date: Oct. 19, 2017

(65) Prior Publication Data

US 2019/0337121 A1 Nov. 7, 2019

(30) Foreign Application Priority Data

Apr. 11, 2016 (SG) ..... 10201602833V

(51) Int. Cl.
*B24C 7/00* (2006.01)
*B24C 5/08* (2006.01)
*B24C 1/10* (2006.01)

(52) U.S. Cl.
CPC ..... *B24C 5/08* (2013.01); *B24C 1/10* (2013.01); *B24C 7/0069* (2013.01)

(58) Field of Classification Search
CPC ..... B24C 1/10; B24C 5/08; B24C 7/0069; F16K 27/048; F16K 27/029;
(Continued)

(56) References Cited

U.S. PATENT DOCUMENTS 2,224,505 A * 12/1940 Unger ..... B05B 5/00 451/93
2,505,049 A 4/1950 Keller
(Continued)

FOREIGN PATENT DOCUMENTS

CN 104084892 A 10/2014
DE 36 00 305 A1 7/1987
(Continued)

OTHER PUBLICATIONS

Electronic Incorporated, Magvalve 398, Jan. 5, 1987 publication.*
(Continued)

*Primary Examiner* — Joseph J Hail
*Assistant Examiner* — Arman Milanian
(74) *Attorney, Agent, or Firm* — Birch, Stewart, Kolasch & Birch, LLP

(57) ABSTRACT

A control valve (100) comprises a conduit (102), a controller (104), a sensor unit (106; 146, 148), a cylindrical housing (112) and one or more regulating columns (124, 126). The conduit further comprises a hollow cylindrical body (114) and two smaller and shorter cylindrical extensions (116, 118) for the insertion of the regulating columns which are orthogonal to the hollow cylindrical body and provide a contactless means to control the flow of the medium (101) in the conduit.

20 Claims, 2 Drawing Sheets

Figure 1:
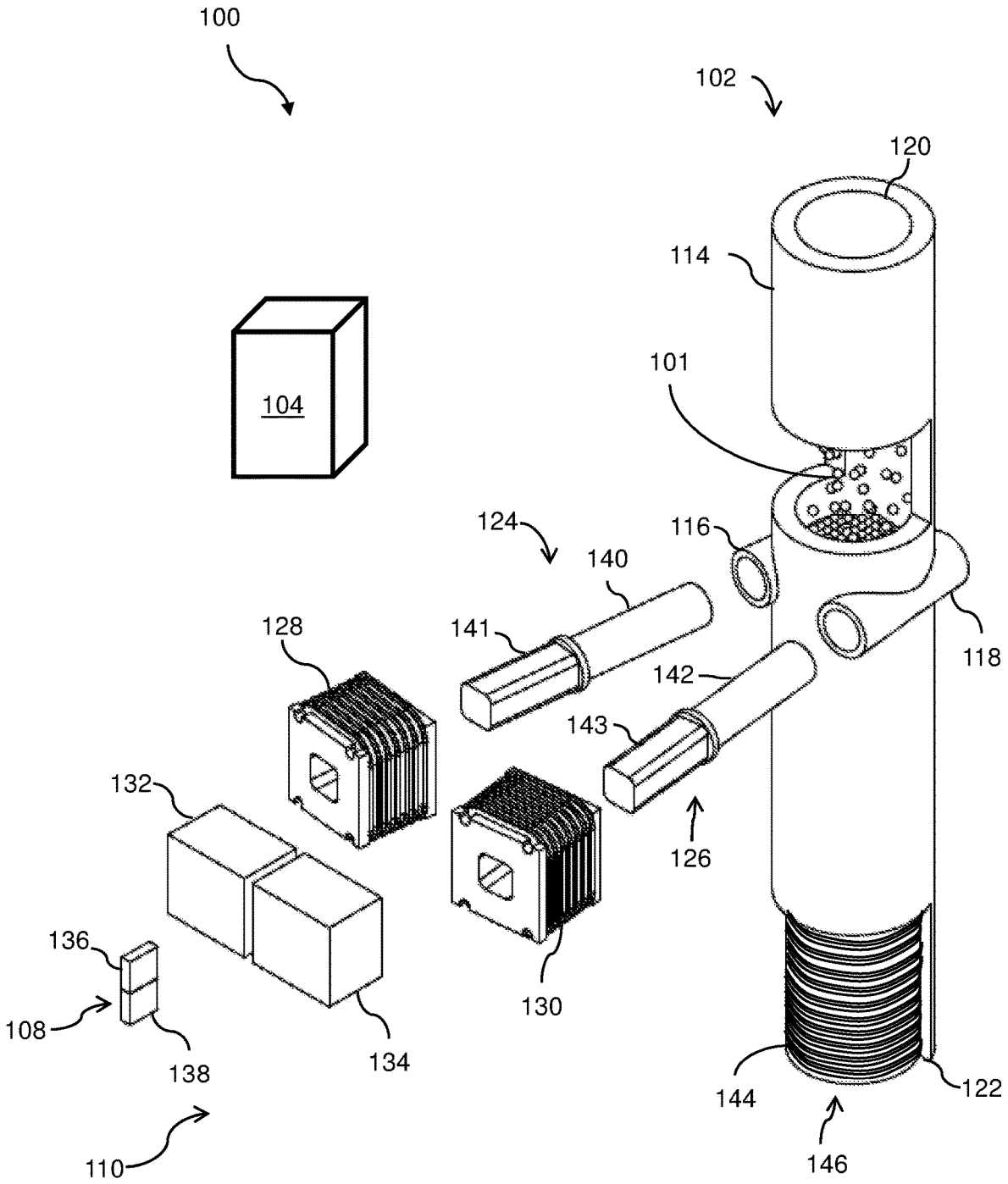

(58) Field of Classification Search
CPC .... F16K 31/082; F16K 66/0046; F16K 7/045; F16K 99/0046; C21D 7/06; Y10T 29/479
USPC ..... 451/39; 251/129.01
See application file for complete search history.

(56) References Cited

U.S. PATENT DOCUMENTS 3,406,704 A * 10/1968 Van Fossen ..... F16K 31/06 137/251.1
3,625,571 A * 12/1971 Kimm ..... B23K 7/08 406/127
4,680,900 A * 7/1987 Wadephul ..... B24C 5/08 451/2
4,873,855 A * 10/1989 Thompson ..... B24C 1/10 72/53
5,176,018 A * 1/1993 Thompson ..... G01P 11/00 72/53
5,212,976 A * 5/1993 Company ..... B24C 1/10 29/90.7
5,271,265 A 12/1993 Pischinger et al.
5,327,755 A * 7/1994 Thompson ..... B24C 1/10 29/90.7
5,362,027 A * 11/1994 Champaigne ..... F16K 1/12 137/251.1
5,433,654 A 7/1995 Clark, Jr. et al.
5,654,496 A 8/1997 Thompson
6,238,268 B1 5/2001 Wern
6,694,789 B2 * 2/2004 Yamamoto ..... B24C 1/10 29/90.7
7,291,058 B2 * 11/2007 Champaigne ..... B24C 1/00 451/38
8,488,292 B2 * 7/2013 Steiner ..... G01R 33/24 361/143
10,451,464 B1 * 10/2019 Champaigne ..... G01F 1/74
2012/0255791 A1 10/2012 Blangé et al.
2014/0373585 A1 * 12/2014 Ache ..... B24C 1/10 72/53
2015/0174636 A1 * 6/2015 Berglund ..... C21D 7/06 72/53
2017/0037983 A1 * 2/2017 Fletcher ..... F16K 31/082

FOREIGN PATENT DOCUMENTS

EP 0 261 376 A2 3/1988
EP 0 540 172 A1 5/1993
EP 1 466 700 A1 10/2004

OTHER PUBLICATIONS

International Preliminary Report on Patentability (PCT/IPEA/409) issued in PCT/SG2017/050099, dated Jul. 23, 2018.
International Search Report (PCT/ISA/210) issued in PCT/SG2017/050099, dated Jun. 14, 2017.
Written Opinion (PCT/ISA/237) issued in PCT/SG2017/050099, dated Jun. 14, 2017.
MagnaValve 578-24 Sales Literature, two (2) pages, Published 2003, Provided to MagnaValve Customers.
MagnaValve Drawings 578-24, eight (8) pages, Published 2008, Place of publication was Mishawaka, Indiana to produce product for sale, as shown in the drawings.
MagnaValve 398(1.25), eight (8) pages, Published 1987, Provided to MagnaValve Customers.
U.S. Government Specifications for Magnetic Valve, seven (7) pages, Published 1988, Provided to machine builders as part of a government contract.

* cited by examiner

CONTROL VALVE FOR SHOT PEENING

The present application claims an earlier priority date of Singapore patent application Number 10201602833V that was filed on 11 Apr. 2016, which has the title of Magnetic Valve for Shot Peening. All subject matter or content of the earlier priority application is hereby incorporated by reference wherever necessary or appropriate.

The present application relates to a control valve for shot peening. The application also relates to shot peening equipment having the control valve. The application further relates to methods of making, assembling, disassembling, installing, configuring, maintaining and using the control valve for shot peening.

Shot peening is a cold work process used to treat surfaces of metal parts to prevent fatigue and stress corrosion failures and prolong product life of the metal parts. In shot peening, small spherical shots are accelerated and bombards the surfaces of the metal parts for finishing. The small spherical shots act like a peen hammer, dimpling the surface and causing compression stresses under multiple overlapping dimples. As the small spherical shots continue to strike the metal parts, the small spherical shots produce the multiple overlapping dimples throughout the surfaces being treated. Surface compression stress at the surfaces strengthens the metal parts, ensuring that the finished metal parts are able to resist fatigue, corrosion, cracking, galling and erosion from surface cavitation. Commonly used media or medium are steel, ceramics and glass beads. Shot peening is an economical and effective method of producing and making surface residual compressive stresses to increase lifespan of the metal parts. Shot peening is also used for hardening the metal parts to improve wear characteristics, straightening distortions, surface texturing. The treated metal parts allow lighter weight structure that exhibits high wear and fatigue resistance. Therefore, the present application aims to a control valve for enhancing performance, reducing operating cost and improving reliability of shot peening.

The present application aims to provide one or more new and useful control valves for shot peening. The application also intends to present one or more new and useful methods for using, configuring, maintaining, upgrading and servicing the control valve for shot peening. Essential features of the present application are provided by one or more independent claims, whilst advantageous features of the present application are presented by their dependent claims respectively.

According to a first aspect, the present application provides a control valve for regulating shot peening. The control valve comprises a tube, channel, chute or conduit for transferring a ferrous shot medium or media. The tube, channel, chute or conduit defines a passage or tunnel for conveying the ferrous shot medium or media. Length, cross-section or shape of the tube, channel, chute or conduit can change over the passage, such as expanding or narrowing. The ferrous shot medium or media are also known as ferric shot medium or media. For example, the ferrous shot medium or media includes spherical cast iron/steel shot or beads for passing through the conduit and casting onto surfaces of metal parts. The control valve also comprises a magnet that is aligned with the conduit for directly applying a magnetic field to the shot ferrous media or medium, which is configured to pass the conduit. The magnet is configured operable to regulate transference of the shot media by changing field intensity, orientation, duration or other parameters of the magnetic field.

The present application proposes to deploy magnetic field to regulate flow behaviour of the ferrous shot medium or media directly, instead of using plungers or doors. Since the magnetic field does not require physical contact with the ferrous shot medium or media during the transference, the control valve avoids issues resulted from wear and tear on components of the control valve due to the physical contact. Besides, since the components are also subject to prolonged periods of bombardment by various shot media in usage, consistency of performance and reliability may deteriorate if involving the physical contact. In contrast, the proposed control valve is able to exert one or more magnetic fields at the conduit such that the ferrous shot medium or media are able to be arrested, decelerated, accelerated, changed in direction or circulated in altering shot peening operation in achieving an optimum result. The magnet is able to maintain its performance and integrity throughout lifespan of the control valve because the magnet is not subjected to wear and tear with the ferrous shot medium or media.

The conduit provides a channel for conveying or directing the ferrous shot medium or media such that the ferrous shot medium or media are enclosed and prevented from escaping from a predetermined path. For example, the conduit presents a sealed tunnel, chute, passage, burrow or tube that prevents foreign particles or moisture from contaminating the ferrous shot medium or media. One or more parts of the conduits optionally include one or more sections that demagnetise or magnetise the ferrous shot medium or media. Accordingly, the ferrous shot medium or media are able to facilitate enhanced or consistent performance of shot peening, which is regulated by the control valve. Additionally, the conduit optionally has one or more filters or dust traps that eliminate foreign particles from the ferrous shot peening medium or media. Hence, the control valve is able to cleanse the ferrous shot peening media, providing excellent shot peening.

The magnet is aligned with the conduit such that the magnetic field provides effective influence along a passage of the ferrous shot peening medium or media. For example, the magnet is a bar magnet having a magnetic pole pointed to a centre of the conduit. Magnetic flux of the bar magnet thus becomes perpendicular with a flow direction of the ferrous shot peening medium or media such that the a sufficiently strong magnetic field of the bar magnet is able to halt flow of the ferrous magnetic medium or media. Alternatively, the magnet encompasses a disc magnet having a pole area pointed to the conduit, which is a type of alignment. The disc magnet applies its magnetic field to the shot peening medium or media by coming close to the conduit, or removes its magnetic field from the shot peening medium or media by detaching from the conduit. Clearly, the magnet is not limited by its shape, strength or mechanism of generating magnetic fields. For instance, the magnet further includes a horseshoe magnet, a sphere magnet, a cylinder magnet, a ring magnet and a cube magnet. The magnet additionally is possibly to be made of ferromagnetic and ferromagnetic materials, paramagnetic substances or diamagnetic means. Types of the magnet contains magnetic metallic elements, composites, rare-earth magnets, single-molecule magnets (SMMs) and single-chain magnets (SCMs), nano-structured magnets, rare-earth-free permanent magnets.

The magnet is configured or operable to regulate, control, modify or change transference of the shot media by the magnetic field. For example, the magnet is used to stop flow of the ferrous medium or media. The ferrous medium or media is released or permitted to travel if the magnetic field is removed from the conduit. The magnet is further configured to change its orientation or polarity such that the magnetic field at the conduit changes its behaviour or characteristics (e.g. field intensity or direction), which alters flow pattern of the ferrous shot peening medium or media. Physical orientation of the magnet with respect to the conduit is flexible or diverse, as long as the magnet is orientated or aligned with the conduit for provides a magnetic field at the conduit in order to influence the ferrous shot medium or media. The magnet alternatively exerts magnetic field at one or more parts of the conduit with the same or different magnetic field direction, polarity or intensity.

Embodiments of the control valve further comprises a sensor or a contactless sensor aligned with the conduit for detecting flow or measuring flow rate of the ferrous shot media. Diverse types of sensors can be implemented for detecting the flow of the ferrous shot medium or media. For example, one or more light sensors, motion sensors, magnetic field sensors, vibration sensors, pressure sensors, electric field sensors, sound sensors and sensors for other physical aspects of environment are able to be installed singularly or in combination, either at the conduit, the magnet or both. For example, the sensor includes a proximity sensor next to a beam. The beam is configured to deflect and touch the proximity sensor if pushed by stream of ferrous shot medium or media. Advantageously, the contactless sensor perceives movement of the ferrous shot media without being worn by the ferrous shot media during usage. For example, a contactless sensor includes a mass flow sensor (MAF) is used to find out the mass flowrate of the ferrous shot media. Furthermore, the contactless sensor includes a speed sensor (e.g. laser surface velocimeter) that is able provide accurate reading to flow rate of the ferrous shot media.

Optionally, the sensor is connected to the magnet directly or indirectly via a controller or control circuit for operating the magnet as a closed feedback loop. The controller or control circuit is operable to manage production of a magnetic field by the magnet depending on input signals from the sensor. For example, the controller shuts off or suspend the ferrous shot media if a flow rate of the ferrous shot media is excessively high. The controller is further able to divert streams of the ferrous shot media to another conduit or object. Alternatively, the controller is able to combine multiple streams of the ferrous shot media together to a single conduit or nozzle, thus intensifying shot peening process. The closed feedback loop is able to provide accurate, timely, adaptive and responsive shot peening process, achieving excellent results. The control circuit is provided by electronic components mounted onto a PCB (printed circuit board), which is optionally encapsulated by one or more epoxy resins.

The sensor or contactless sensor can comprise an inductor aligned with the conduit for sensing the ferrous shot media. For example, the inductor includes a cylinder that is wound with an insulated wire. The cylinder is inserted into the conduit such that the ferrous shot medium or media causes inductance variation when passing through the cylinder. The inductor provides silent, reliable and energy efficient detection of the ferrous shot medium or media so that the control valve is able to operate autonomously without any attention from an operator or maintenance technician.

The magnet may comprise an electromagnet (also known as energised magnet), a permanent magnet or both. The electromagnet comprises one or more coils winding over a magnetic conductor (i.e. magnetic material with a high magnetic permeability as compared to surrounding air, typically made of ferromagnetic metal or ferrimagnetic compounds) of the electromagnet. Since a magnetic field of the electromagnet is produced by an electric current, the electromagnet is able to change its polarity or field intensity by regulating the electric current. In practice, the control valve is able to generate diverse, complex or predetermined patterns of magnetic fields for manipulating the ferrous shot medium or media, providing abundant functions or functions to the control valve. The electromagnet is further able to generate time-dependent or geometry-dependent magnetic fields so that the shot peening process is able to be tailored according to different objects.

The electromagnet can comprise a magnetic conductor or magnetic core for extending to the conduit. The magnetic conductor or magnetic core is able to assume any shape or size in order to suit geometry of the conduit. The magnetic conductor or magnetic core is further able to extend magnetic field or flux of the magnet to one or more distant place. For example, the magnetic conductor is a shaft having a first end inserted into a coil winding of an electromagnet, and a second end implanted inside the conduit such that a strong magnetic field is able to be projected within the conduit. Multiple pieces of the magnetic conductor or magnetic core can extend from the same magnet, thus presenting magnetic fields to several places, or the same place from different angles. The magnetic core or conductor is a piece of ferromagnetic material like iron for increasing a magnetic field. The magnetic core or conductor can be made of air, vacuum or ferrite, which is a ferromagnetic/ferromagnetic ceramic compound.

The magnet may further comprise a permanent magnet that is optionally connected to the electromagnet, the magnetic conductor or both in series or serially. Since the permanent magnet has predetermined or fixed polarities, the electromagnet is able to be controlled to conform or oppose magnetic fluxes of the permanent magnet. When conforming with the permanent magnet, the electromagnet is able to enhance or strengthen a magnetic field of the permanent magnet. In contrast, when opposing magnetic flux of the permanent magnet, the electromagnet is able to diminish, cancel or neutralise the magnetic field of the permanent magnet. Moreover, if sufficiently strong, the electromagnet is able to present magnet flux or field opposite to those of the permanent magnet. Alternatively, instead of being aligned in a straight line, multiple pieces of the permanent magnet, the electromagnets and magnetic conductors are able to form diverse geometries (e.g. intersect each other), which provides numerous or unlimited patterns of magnetic fields.

Some types of the control valve include the magnet that can comprise a first magnet, a second magnet, additional magnets or any of their extensions that are spaced apart from each other. For example, a first magnetic core extends from the first magnet, whilst a second magnetic core extends from the second magnet. The first core and the second core are inserted into the conduit such that the first core and the second core are located at opposite sides of the conduit. The ferrous shot medium or media are configured to pass between the first core and the second core for providing shot peening. Alternatively, the first magnet, the second magnet or any of their extensions are disposed at opposite sides of the conduit.

The first magnet, the second magnet or any of their extensions can be disposed along at the same side of the conduit for accelerating, decelerating or holding the ferrous shot medium or media. For example, an array of several electromagnets are placed along the conduit for projecting magnetic fields into the conduit. The several electromagnets optionally provide continuous acceleration or deceleration (e.g. altering direction of travelling) to the ferrous shot medium or media in usage, offering controlled driving force to shot peening.

The first magnet, the second magnet or any of their extensions may be parallel to each other (e.g. vertical, horizontal, etc.) either at opposite sides of the conduit, at the same side of the conduit, or around the conduit. Alternatively, the first magnet, the second magnet or any of their extensions are at an angle (e.g. intersect at a distance) with respect to each other. Therefore, the ferrous shot medium or media may experience multiple magnetic fields or flux of different intensity, direction and polarity, which offers flexibility in controlling shot peening process.

The control valve can additionally comprise a control unit or controller that is connected to the magnet, the sensor or both. Sizes, angles of projection, shapes, field intensities of the electromagnets can be regulated according to specific requirements. Additionally, the permanent magnet can be moved or rotated to adjust its projection of magnetic field, whether independently or in combination with the electromagnets.

The control valve may further comprise a housing that optionally encloses the magnet and other components (e.g. electronic circuits) of the control valve for preventing infiltration of foreign particles or moisture. The housing may be cylindrical or resemble any other regular shapes (e.g. sphere, platonic solid, cube, cone, pyramid, hemisphere, cuboid, prism, etc.) for protecting the magnet and other components. The housing may be hermetically sealed, or with perforations at its lateral sides or bottom for ventilation.

The housing can comprise one or more detachable covers for allowing access to internal components of the control valve. Manufacturers or users are able to adjust, configure, repair or replace the internal components when necessary, such as for hardware upgrading. For example, the one or more covers include a half spherical lid and a flat lid that seal opposite ends of a cylindrical housing by removable fasteners (e.g. screws) and gasket (e.g. O-rings, packing or toric joint) so that the housing becomes water proof or dust proof according to relevant IP Code, International Protection Marking or Ingress Protection Marking (e.g. IEC standard 60529). Other parts of the control valve may be similarly sealed or protected.

The present application additionally provides a shot peening equipment or machine (e.g. wheel blast machines, air & wet blast machines) for enhancing fatigue strength of components or producing a compressive residual stress layer and modifying mechanical properties of metals and composites. The shot peening equipment or machine comprises the control valve and a nozzle connected to the control vale directly or indirectly for directing the shot media to an object. The nozzle may have diverse shapes or sizes for optimising shot peening.

According to a second aspect, the present application provides a method for regulating a ferrous shot media. The method comprises a first step of providing a ferrous shot media; a second step of presenting (e.g. providing or applying) a magnetic field at a flow path of to the ferrous shot medium or media for regulating transference of the ferrous shot media; and a third step of collecting used shot media at an outlet for recycling to an inlet of a shot peening machine. Some of the steps may be divided, combined or changed in sequence. Since the magnetic field is able to be precisely or flexibly regulated, the method offers enhanced, reliable and consistent shot peening process. Maintenance of the control valve is much reduced because parts of the magnetic field do not require physical contact with the ferrous shot media, prolonging product life of the control valve.

The method can further comprise a step of detecting the transference or flow condition of the ferrous shot media, either by a contact sensor or a contactless sensor. The method thus is able to measure or record the transference or flow condition such that a shot peening process is able to be precisely controlled. The step of presenting the magnetic field optionally comprises regulating the magnetic field (e.g. field intensity, direction, duration, pulsation or pattern) according to the transference or flow condition of the ferrous shot media as detected by the sensor or other requirements. Signals of the sensor or sensors are received, processed and used to manage the shot peening process, such as by adjusting magnetic field. Accordingly, the method advantageously provides a close loop control system that is stable, precise and robust for shot peening.

The step of presenting the magnetic field may comprise steps of accelerating, decelerating, stopping, shaking, circulating, pushing the ferrous media or a combination of any of these. The step of presenting the magnetic field may additionally comprise a step of conducting magnetic field from a permanent magnet, an electromagnet or both. Since the magnetic field is able to flexibly controlled, the method offers users and manufacturers abundant opportunities to regulate the shot peening process.

The control valve is also known as a magnetic valve that is able to change direction or orientation of a magnetic field, which is generated by a magnet of the magnetic valve. For example, polarity of the magnet can be altered by reversing electric current flowing through an electromagnet of the magnetic valve. The alternating of polarity causes magnetising or demagnetising (e.g. degaussing) of peening shots flowing through a shot conduit of the magnetic valve so that control response to the flow of the peening shot become much faster, accurate or complete. Dripping or lagging of the peening shots can possibly be completely eliminated. The magnetic valve is also able to handle heavier flow of peening shots by using less expensive electromagnets with reliable performance.

According to a third aspect, the present application provides a magnetic valve that comprises a shot conduit for transporting shot particles; a magnet adjacent to the shot conduit for exerting a magnetic field to the shot particles; and an oscillator connected to the magnet for changing polarity of the magnetic field.

The oscillator can comprise at least one electromagnet and a control circuit connected together. The control circuit is operable to supply alternative current to the at least one electromagnet. The magnet may comprise a first electromagnet and a second electromagnet in forming a pair hose ends are attached to lateral sides of the shot conduit. The magnet optionally further comprises at least one permanent magnet. Some embodiments of the at least one permanent magnet is serially connected to the at least one electromagnet such that magnetic field intensity of the magnet is operable to be modified by the at least one permanent magnet.

The oscillator can further comprise an electronic oscillator for converting direct current from a power supply to an alternating current. The magnet may comprise at least one magnetic core for guiding magnetic field of the magnet. Preferably, the magnet valve further comprises a magnetic field sensor attached to the shot conduit for monitoring flow rate of peening shots in the shot conduit. In some cases, the magnetic field sensor is connected to the magnet for modifying magnetic field of the magnet depending on flow rate of peening shots at the shot conduit. The magnet sometimes comprises two or more pair of magnetic poles for providing multiple magnetic fields at the shot conduit. The two or more pair of magnetic poles sometimes are configured to providing the multiple magnetic fields intersecting each other. In some cases, the two or more pair of magnetic poles are configured to change orientation of the magnetic fields.

The present application additionally provides a shot peening machine that comprises the magnetic valve of any of the preceding claims; and a microprocessor connected to the magnetic valve for regulating operation of the shot peening machine. The shot peening machine can further comprise a touchscreen connected to the microprocessor for providing an interactive user interface.

According to a fourth aspect, the present application provides a method for regulating a shot peening process. The method comprises a first step of providing a shot conduit; a second step of present a magnet adjacent to the shot conduit for exerting a magnetic field to the shot particles passing through the shot conduit; and a third step of oscillating the magnet for changing polarity of the magnetic field. Some of these steps may be changed in sequence, divided or combined.

The method can further comprise a step of causing the magnetic field to oscillate from 8 Hz to 30 Hz. The method may further comprise step of supplying peening shots through the shot conduit at a rate from 1 kilogram per minute to 400 kilograms per minute. The method optionally further comprises a step of monitoring flow rate of the peening shots. Embodiments of the method further comprises a step of adjusting oscillation rate of the magnet depending on the flow rate of the peening shots. In comes cases, the method further comprises a step of regulating magnetic field intensity of the magnetic field of the magnet.

The accompanying figures (FIGS.) illustrate embodiments and serve to explain principles of the disclosed embodiments. It is to be understood, however, that these figures are presented for purposes of illustration only, and not for defining limits of relevant inventions.

Figure 2:
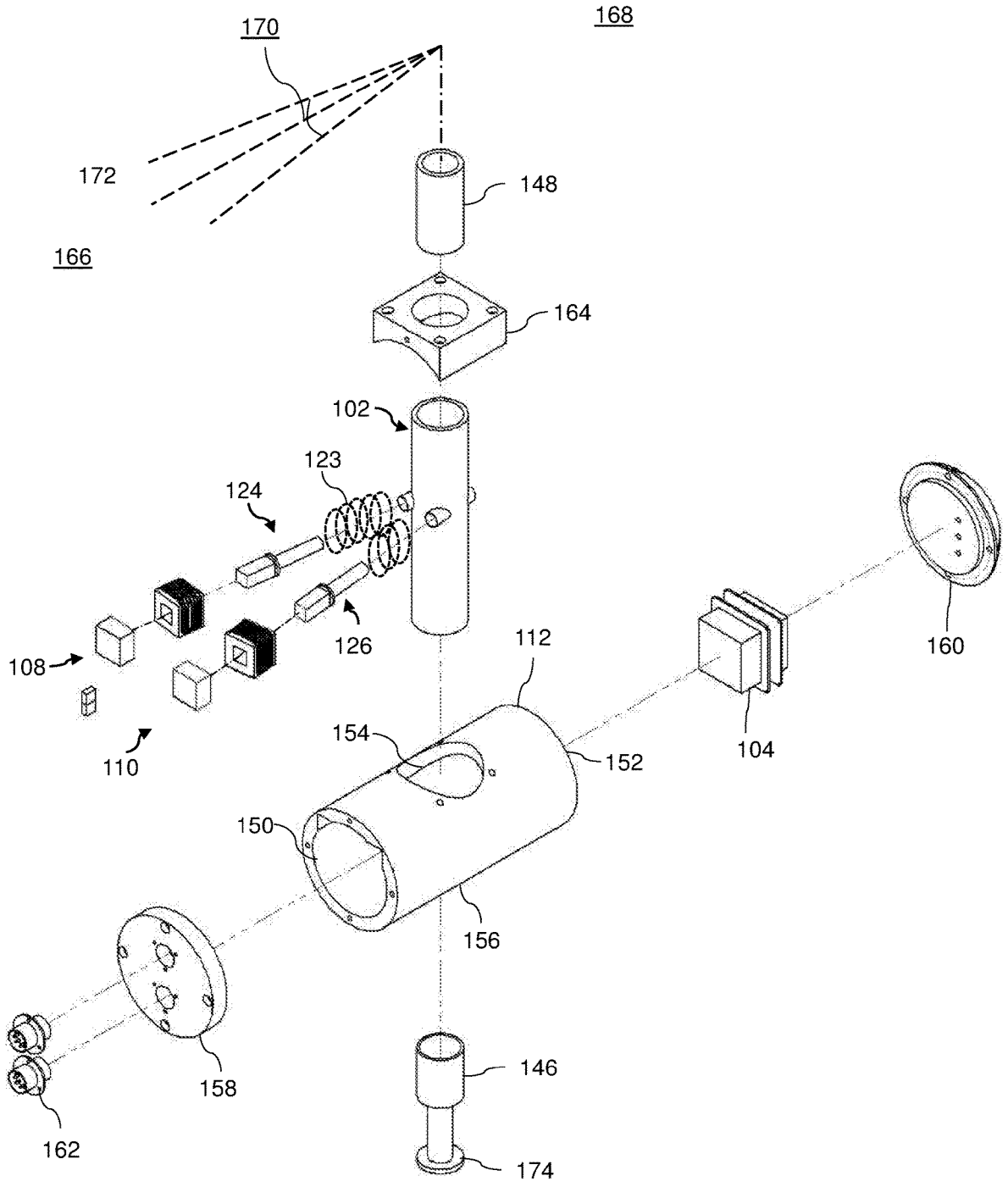

FIG. 1 illustrates a first embodiment of a control valve without a cylindrical housing; and FIG. 2 illustrates the first embodiment of the control valve installed in a cylindrical housing and a nozzle attached to an end of a bottom magnetic field sensor.

Exemplary, non-limiting embodiments of the present application will now be described with references to the above-mentioned figures.

FIG. 1 and FIG. 2 illustrate a first embodiment of a control valve 100. In particular, FIG. 1 shows a control valve 100 without a cylindrical housing 112.

Ferromagnetic media 101 (e.g. cast iron balls of similar or diverse sizes) are supplied through the inlet port 120 travelling down in the conduit 102 by gravitational force.

The control valve 100 comprises a conduit 102, a controller 104, a sensor unit 106, at least one regulating column and a cylindrical housing 112.

The conduit 102 further comprises a hollow cylindrical body 114 and two smaller and shorter cylindrical extensions 116,118 joined orthogonally to the hollow cylindrical body 114. On one end of the hollow cylindrical body 114 is the inlet port 120. On the opposite end of the hollow cylindrical body 114 is the outlet port 122. The approximate length of the hollow cylindrical body 114 is one hundred and fifty millimetres, 150 mm. The cross sectional diameter of the hollow cylindrical body is about thirty millimetres, 30 mm.

Approximately in the middle length of the hollow cylindrical body 114, a first concentric hole is bored on a surface of the cylindrical body 114 and a second concentric hole is bored on the surface in an opposite side of the cylindrical body 114.

The diameter of the said concentric holes is about twenty millimetres, 20 mm. The two concentric holes are further enlarged and elongated by cutting in an orthogonal direction relative to the length of the cylindrical body 114 maintaining the twenty millimetres, 20 mm diameter. The depth of the cut for the two bored holes is about ten millimetres, 10 mm at a front section and slightly more than ten millimetres, 10 mm at a rear section. This forms two slanted bored elongated holes in the middle cross section of the hollow cylindrical body 114. The hollow cylindrical body 114 is made of a metallic material of a non-ferrous characteristics. One example can be brass which contains the main constituent elements of copper and zinc. Alternatively, aluminium can be used.

There is a first cylindrical extension 116 and a second cylindrical extension 118 that are approximately forty millimetres, 40 mm in length and having a hollow internal cavity which is approximately twenty millimetres, 20 mm in diameter.

In a first distal end of the first cylindrical extension 116, there is a concentric opening with a diameter of less than twenty millimetres, 20 mm and in a second distal end, opposite to the first distal end is enclosed. On a length of the first cylindrical extension 116 is a cavity bored of about thirty millimetres, 30 mm in length with a depth of one half of the diameter or about more than ten millimetres, 10 mm longitudinally. The bored cavity (not shown) having access to the hollow internal cavity of the said first cylindrical extension 116. The second cylindrical extension 118 is made similarly according to the first cylindrical extension 116. The first and the second cylindrical extensions 116,118 are made of non-ferrous material like brass or aluminium.

The first and the second cylindrical extensions 116,118 with the bored cavities are joined orthogonally relative to the two bored surfaces of the hollow cylindrical body 114. The cylindrical extensions 116,118 and the hollow cylindrical body 114 can be welded together or can be moulded in a cast to form a seamless conduit.

A first regulating column 108 further comprise a first magnetic field conductor 124, a first coil 128, a first terminal block 132 and a first permanent magnet 136 that are serially connected. Similarly, a second regulating column 110 further comprise a second magnetic field conductor 126, a second coil 130, a second terminal block 134 and a second permanent magnet 138 that are sequentially joined together.

The first magnetic field conductor 124 has a first cylindrical rod 140 and a first octagonal shaped rod 141 joined together at one end. The first magnetic field conductor 124 with the cylindrical rod end is inserted into the first distal end of the first cylindrical extension 116 having a concentric opening. The first magnetic field conductor 124 is made of ferrous material like an alloy containing iron and other elements. The first magnetic conductor 124 is slightly more than eighty millimetres in length from the first cylindrical rod 140 end to the first octagonal shaped rod 141 end. The first cylindrical rod 140 has a cross sectional diameter of approximately twenty millimetres, 20 mm so as to insert into the first cylindrical extension 116 of the cylindrical body 114. The cross sectional width of the first octagonal shaped rod 141 is approximately twenty millimetres, 20 mm.

The first coil 128 has a "square" shaped periphery with an octagonal shaped hollow core with a metallic wire coiled around the core encompassing the entire surface of the length of the first coil 128. The core is made of a magnetic material with a high magnetic permeability. The hollow core of the first coil 128 is joined to the first octagonal shaped rod 141 of the first magnetic field conductor 124. The first coil 128 "square" shaped periphery has a similar length and width which is approximately thirty-five millimetres, 35 mm on each side. The hollow core of the first coil 128 has an inner width of about twenty millimetres, 20 mm allowing the insertion of the first octagonal shaped rod 141.

A first terminal block 132 is joined to the opposite side of the first coil 128. The first terminal block 132 is a square shape soft magnet with relatively low coercecivity (i.e. magnetic coercivity, coercive field or coercive force) as compared to the first permanent magnet 136. The first terminal block 132 has a cross sectional shape of a square having a dimension of thirty-five millimetres, 35 mm on each length. The thickness of the first terminal block is approximately twenty millimetres, 20 mm.

The first permanent magnet 136 is joined to the side of the first terminal block 132 by magnetic attraction.

A second regulating column 110 is assembled similar to the first regulating column 108 with similar dimensions. A second cylindrical rod 142 of the second magnetic field conductor 126 is inserted into the second cylindrical extension 118. A second octagonal shaped rod 143 of the second magnetic field conductor 126 is inserted into a hollow core of a second coil 130. A second terminal block 138 is joined at the opposite side of the second coil 130. A second permanent magnet 138 is magnetically attracted to a side of the second terminal block 134, the first terminal block 132 and the first permanent magnet 136. The first terminal block 132 and the second terminal block 134 are joined at the sides by the magnetic attractive forces of the first permanent magnet 136 and the second permanent magnet 138 stacked above each other which are positioned in between the two terminal blocks 132,134. The two regulating columns 108, 110 formed a "V" shaped magnet with the first and second magnetic field conductor 124,126 converging and inserted into the two cylindrical extensions 116,118 of the hollow cylindrical body 114 respectively.

The ferromagnetic materials used for the magnetic field conductors 124, 126 are optionally iron, nickel, cobalt and alloys of these materials.

The controller unit 104 comprises an input means, a processing unit and an output means having a tactile display, a microcontroller, a plurality of electronics components, electrical connections and an output port.

The electrical connections provide wiring from the first coil 128, the second coil 130, the tactile display and a bottom magnetic field sensor 146 to the microcontroller. The controller unit 104 and the tactile display is located externally, from the conduit 102.

The sensor unit 106 comprises at least one sensor. One of them is located inside the conduit 102 in particular around the periphery of the hollow cylindrical body 114 nearing the inlet port 120 as shown in FIG. 2 and the outlet port 122 of the conduit 102. The magnetic field sensors 146,148 is constructed using two hollow cylindrical frame 144 with a wire coil around the periphery along its whole length. The length of the hollow cylindrical frame 144 is about fifty millimetres, 50 mm with a diameter shorter than the hollow cylindrical body 114.

FIG. 2 illustrates the first embodiment of the control valve 100 installed in a cylindrical housing 112 and a nozzle 174 attached to an end of a bottom magnetic field sensor 146.

The cylindrical housing 112 positioned on a horizontal plane with two circular ends and two circular holes 154,156 bored orthogonally from top to bottom relative to the horizontal plane of the said housing 112, a flat lid 158 with at least one communication port 162 located at a first circular end 150 of the said housing 112, the controller unit 104 disposed at the second circular end 152 of the said housing 112 and a half-spherical lid 160 enclosing the controller unit 104 to the second circular end 152 of the cylindrical housing 112. The cylindrical housing has an approximate length of two hundred millimetres, 200 mm and a cross sectional diameter of approximately ninety millimetres, 90 mm to accommodate the two regulating columns 124,126 of conduit 102 within.

The conduit 102 having the cylindrical body 114 with two cylindrical extensions 116,118, magnetic field sensors 146, 148 and two regulating columns 108,110 is installed into the cylindrical housing 112 through the two circular holes 154,156. The outlet port 122 of the conduit 102 extends out of the bottom circular hole 156. The inlet port 120 of the conduit 102 extends out of the top circular hole 154. The cylindrical extensions 116,118 and the regulating columns 108,110 are within the cylindrical housing 112.

The first regulating column 108 and the second regulating 110 are assembled first prior to inserting into the cylindrical extensions 116,118. The regulating columns 108,110 are assembled by having the first octagonal shaped rod 141 inserted into the first coil 128, then having the first terminal block 132 attached to the opposite side of the first coil 128. The first permanent magnet 136 is then placed on one side of the first terminal block 132. The second regulating column 110 is assembled as per the first regulating column 108. The second permanent magnet 138 and the first permanent magnet 136 is placed on top of each other and sandwiched between the first terminal block 132 and the second terminal block 134.

The cylindrical extensions 116,118 of the conduit 102 are positioned at a horizontal plane, on a same side 166 and spaced apart equally by an acute angle of less than ninety degrees. An imaginary reference line 172 taken from the centre of a vertical axis of the conduit 102 extending towards the same side 166. The cylindrical extensions 116,118 positioned at an angle of ±fifteen degrees, ±15° with reference to the imaginary reference line 172 making a sum of angle 170 of thirty degrees, 30° between the two cylindrical extensions.

A screw-thread hole in the middle of a square-shaped ferrule 164 is fastened by screwing on the top end of the cylindrical body 114 which has a corresponding screw thread around the periphery of the cylindrical body 114.

The square-shaped ferrule 164 with the fastened cylindrical body 114 is fastened to the cylindrical housing 112 by using four screws fastened to the four corners of the square-shaped ferrule 164.

The flat lid 158 is screwed into the periphery at the first end 150 of the cylindrical housing 112 using four screws. At the centre area of the flat lid 158 are two communication serial ports 162.

The half spherical lid 160 is screwed into the periphery at the second end 152 of the cylindrical housing 112 using four screws.

The cylindrical housing 112, the flat lid 128, the half spherical lid 160 and the square-shaped ferrule 164 are made of a non-ferromagnetic metal. One example is aluminium.

The conduit 102 provides a passage for the media 101 to pass though from the inlet port 120 to the outlet port 122. At the middle of the cylindrical body 114 are two elongated bored holes across the said body 114. The elongated bored holes are slanted. The front section has a shallow cut and the rear section has a deeper cut. The angled elongated bored holes on the cylindrical hollow body 114 are to support the cylindrical extensions 116,118 that are to be joined by welding.

The cylindrical extensions 116,118 provide a housing for the regulating columns 108,110 to be inserted. The two hollow internal cavities of the first cylindrical extension 116 and the second cylindrical extension 118 provide two exposed guides for the regulating columns 108,110.

The regulating columns 108,110 provide either an attractive or an opposing magnetic field through the magnetic field conductors 124,126, the coils 128,130, the terminal blocks 132,134 and the permanent magnets 136,138. The magnetic field conductors 124,126 are slotted into the cylindrical extensions 116,118 converging at the hollow cylindrical body 114 so that the media 101 travelling in the conduit 102 can be manipulated easily versus being parallel when there is the presence of a magnetic field.

The coils 128,130 are electromagnets with an octagonal shaped core with metallic wires coil around. There are electrical wirings connected to the coils 128,130 to control the amount of electrical current flowing through the coil 128,130 to generate a magnetic field to weaken or reinforce the magnetic field of the permanent magnets 136,138.

The terminal blocks 132,134 provide a closed loop guide for the magnetic flux to travel from one regulating column to the next regulating column. There are two permanent magnets 136,138 stacked up and exerting its attraction force on the terminal blocks 132,134 to complete the closed loop guide.

The controller unit 104 provides a control and maintenance of the supply current to the one or/and two coils at the regulating columns 108,110 and hence controls the magnetic flux travelling in the two columns 108,110.

In addition, the controller unit 104 has an input means, having a tactile display to provide an input from a user to switch on and off the control valve 100, to control the strength of the magnetic field, to control the rate of flow of the media 101, to control the rate of fluid flow for example air. The microcontroller contains an algorithm to process the inputs from the user and the sensor(s) and controls the external components via the output port. The output port controls the supply current to the coil 128,130, controls the rate of media flow, controls the amount of media into the conduit 102, controls the fluid intake and controls the rate of fluid flow. The microcontroller performs periodic checks on the flow sensor value. Once the microcontroller detects an abnormal flow rate of media 101 in the conduit 102, the microcontroller will energise the two coils 128,130 to inhibit or the media 101 to flow through.

The sensor unit 106 provides at least a detection of the rate of flow of the media 101 flowing in the conduit 102 by sensing the difference in the change of magnetic flux passing through the hollow cylindrical frame 144. Other sensor inputs may include the detection of the flow rate of the fluid, detection of the magnetic flux in the regulating columns 108,110, the detection of the presence of a user input and the detection of the presence of media 101 in the conduit 102.

The cylindrical housing 112 provides an insulation from the external noises for the regulating columns 108,110. In addition, the cylindrical housing 112 provides a protective casing against the dust and grime making it suitable for the rugged environment.

In use, the control valve 100 provides a two-mode operation, an operating mode and a non-operating mode. The operating mode having a peening state and a maintenance state.

The control valve 100 in its non-operating state permits the media 101 to go through the conduit 102 from the inlet port 120 to the outlet port 122. The regulating columns 108,110 inserted in the two cylindrical extensions 116,118 have two permanent magnets 136,138 at the two terminal blocks 132,134 imposing a magnetic field on the media 101 which is of a ferromagnetic material through the two terminal blocks 132,134, the two coils 128,130 and the two magnetic field conductors 124,126.

The magnetic field sensors 146,148 which is connected to the microcontroller detects the flow of media 101 through the conduit 102. In the case when there is a trace of media 101 flowing through or a presence of a leak, a signal from the sensor 146,148 is sent to the microcontroller creating a feedback loop which increases the supply current to the coils 128,130. Hence, increasing the magnetic field strength stopping the media 101 at the magnetic field conductors 124,126 inside the conduit 102.

The control valve 100 in its operating mode controls the media 101 going through the conduit 102. The permanent magnets 136,138 supplied a base magnetic field through the magnetic field conductors 124,126 in its non-operating mode.

In a shot peening operation or process, the two coils 128, 130 at the regulating column 108,110 is supplied with the electric current. A high supply current through the coils 128,130 will produce a high magnetic flux and hence interrupt the base magnetic field produced by the permanent magnets 136,138. The interruption can decrease the base magnetic field or increasing the base magnetic field. A stronger magnetic field produced by the coils 128,130 as compared to the base magnetic field, will exert a stronger influence on the media 101 travelling in the conduit 102, which will stop the flow of the media 101. A balance is made between the base magnetic field and the induced magnetic field to control the media 101 flowing.

The balance is controlled by the user inputting at the tactile display. One input can be the rate of flow of the media. If a fast rate of media flow was desired, a negative magnetic flux in the coils 128,130 will cancel off the positive magnetic field providing a least resistance flow of the media 101. Conversely, if a slow rate of media flow is desired, the user can input a value that does not overpower the magnetic field strength of the permanent magnets 136,138. The entered value translates to a set supply current to the coils 128,130 which determines the magnetic flux and the magnetic field strength.

In the maintenance state, the magnetic field produced by the coils 128,130 can change between positive and negative magnetic fields in a determined time frame. This is to discharge any media 101 that may be attracted to the magnetic field conductors 124,126 in the conduit 102. The two coils 128,130 can have opposing magnetic fields supplied by at least one current supply conducting in the opposite directions in the coils 128,130. The two coils 128,130 can also have carrying magnetic field strengths on each coil.

Alternatively, the user input can be performed using a standard keyboard, a pointing device like a mouse to control the control valve 100. Appropriate input options like USB ports, serial ports are to be present to allow other input methods.

In the application, unless specified otherwise, the terms "comprising", "comprise", and grammatical variants thereof, intended to represent "open" or "inclusive" language such that they include recited elements but also permit inclusion of additional, non-explicitly recited elements.

As used herein, the term "about", in the context of concentrations of components of the formulations, typically means +/−5% of the stated value, more typically +/−4% of the stated value, more typically +/−3% of the stated value, more typically, +/−2% of the stated value, even more typically +/−1% of the stated value, and even more typically +/−0.5% of the stated value.

Throughout this disclosure, certain embodiments may be disclosed in a range format. The description in range format is merely for convenience and brevity and should not be construed as an inflexible limitation on the scope of the disclosed ranges. Accordingly, the description of a range should be considered to have specifically disclosed all the possible sub-ranges as well as individual numerical values within that range. For example, description of a range such as from 1 to 6 should be considered to have specifically disclosed sub-ranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

It will be apparent that various other modifications and adaptations of the application will be apparent to the person skilled in the art after reading the foregoing disclosure without departing from the spirit and scope of the application and it is intended that all such modifications and adaptations come within the scope of the appended claims.

The invention claimed is:

1. A control valve for regulating shot peening, the control valve comprising:

a conduit for transferring a ferrous shot medium;

a magnet aligned with the conduit for applying a magnetic field to the ferrous shot medium; and an oscillator connected to the magnet for causing the magnetic field to oscillate from 8 Hz to 30 Hz, wherein the magnet comprises a first magnet and a second magnet, the first magnet and the second magnet being at an angle so as to not be parallel with respect to each other for regulating transference of the ferrous shot medium by the magnetic field, and wherein the oscillator is configured to change polarity of the magnetic field.

2. The control valve of claim 1, wherein the magnet comprises an electromagnet.

3. The control valve of claim 2, wherein the electromagnet comprises a magnetic conductor as an extension.

4. The control valve of claim 1, further comprising a control circuit that is connected to the magnet for operating the magnet as a closed feedback loop.

5. A shot peening equipment for enhancing fatigue strength of components, the shot peening equipment comprising:

the control valve of claim 1; and a nozzle connected to the control valve for directing the ferrous shot medium to an object.

6. A method for regulating a ferrous shot medium, the method comprising:

providing ferrous shot medium;

presenting a first magnet and a second magnet that are at an angle so as to not be parallel with respect to each other for generating a magnetic field to the ferrous shot medium in order to regulate transference of the ferrous shot medium;

oscillating the magnet for causing the magnetic field to oscillate from 8 Hz to 30 Hz and for changing polarity of the magnetic field; and circulating used shot medium in a shot peening machine.

7. The method of claim 6, wherein the presenting the first magnet and the second magnet comprises regulating the magnetic field according to the transference of the ferrous shot medium.

8. The method of claim 6, wherein the presenting the first magnet and the second magnet comprises accelerating, decelerating, stopping, shaking, pushing the ferrous medium or a combination thereof.

9. The method of claim 6, wherein the presenting the first magnet and the second magnet comprises conducting the magnetic field from a permanent magnet, an electromagnet or both.

10. The control valve of claim 1, wherein the oscillator comprises an electronic oscillator for converting direct current from a power supply to an alternating current.

11. A control valve for regulating shot peening, the control valve comprising:

a conduit for transferring a ferrous shot medium;

a magnet aligned with the conduit for applying a magnetic field to the ferrous shot medium;

an oscillator connected to the magnet for causing the magnetic field to oscillate from 8 Hz to 30 Hz; and a housing for enclosing the magnet in order to prevent infiltration of foreign particles or moisture, wherein the housing comprises at least one detachable cover for allowing access to internal components of the control valve, and wherein the oscillator is configured to change polarity of the magnetic field.

12. The control valve of claim 11, wherein the magnet comprises an electromagnet.

13. The control valve of claim 12, wherein the electromagnet comprises a magnetic conductor as an extension.

14. The control valve of claim 11, further comprising a control circuit that is connected to the magnet for operating the magnet as a closed feedback loop.

15. The control valve of claim 11, wherein the oscillator comprises an electronic oscillator for converting direct current from a power supply to an alternating current.

16. The method of claim 6, further comprising adjusting oscillation rate of the magnet according to flow rate of the ferrous shot medium.

17. The control valve of claim 1, wherein the conduit further comprises a first cylindrical extension and a second cylindrical extension for inserting the first magnet and the second magnet, respectively, and wherein the first cylindrical extension and the second cylindrical extension are spaced apart equally by an acute angle of less of than less ninety degrees.

18. The control valve of claim 17, wherein the first magnet and the second magnet comprises a first cylindrical rod and a second cylindrical rod configured to insert into the first cylindrical extension and the second cylindrical extension, respectively.

19. The control valve of claim 11, wherein the conduit further comprises a hollow cylindrical body, and a first cylindrical extension and a second extension joined orthogonally to the hollow cylindrical body.

20. The control valve of claim 19, wherein the magnet comprises a first cylindrical rod and a second cylindrical rod configured to insert into the first cylindrical extension and the second cylindrical extension, respectively.

* * * * *